US007384086B2

(12) United States Patent
Lukaszynski et al.

(10) Patent No.: US 7,384,086 B2
(45) Date of Patent: Jun. 10, 2008

(54) DEVICE FOR REMOVING OR INSERTING A FUSE WITH AN IMPROVED HOLDING AND RELEASE MECHANISM

(75) Inventors: Tadeusz Lukaszynski, Vilsbiburg (DE); Peter Füssl, Vilsbiburg (DE); Robert Saller, Egglkofen (DE)

(73) Assignee: Lisa Dräxlmaier GmbH, Vilsbiburg (DE)

( * ) Notice: Subject to any disclaimer, the term of this patent is extended or adjusted under 35 U.S.C. 154(b) by 0 days.

(21) Appl. No.: 10/882,296

(22) Filed: Jul. 2, 2004

(65) Prior Publication Data

US 2005/0001439 A1 Jan. 6, 2005

(30) Foreign Application Priority Data

Jul. 4, 2003 (DE) ..... 103 30 263

(51) Int. Cl.
*B25B 9/02* (2006.01)

(52) U.S. Cl. ..... 294/99.2; 29/278; 81/3.8

(58) Field of Classification Search ..... 294/99.1, 294/99.2; 81/3.8; 29/747, 758, 764, 278; D7/686

See application file for complete search history.

(56) References Cited

U.S. PATENT DOCUMENTS

| | | | | | |
|---|---|---|---|---|---|
| 3,215,006 | A | * | 11/1965 | Angelo | 294/99.2 |
| 3,628,824 | A | * | 12/1971 | Leuw et al. | 294/99.2 |
| 4,141,138 | A | * | 2/1979 | Quick | 294/99.1 |
| 4,226,459 | A | * | 10/1980 | Natalicio | 294/99.2 |
| 4,841,819 | A | | 6/1989 | Williams | |
| 5,044,058 | A | * | 9/1991 | Voss | 294/99.2 |
| 5,226,230 | A | * | 7/1993 | Klinger | 29/237 |
| 5,666,865 | A | * | 9/1997 | Ito | 81/3.8 |
| 5,751,208 | A | | 5/1998 | Martinez | |

FOREIGN PATENT DOCUMENTS

| | | | |
|---|---|---|---|
| DE | 81 34 248 | U1 | 11/1981 |
| DE | 695 10 639 | T2 | 10/1995 |
| EP | 0710974 | A1 | 5/1996 |
| EP | 1245337 | A2 | 10/2002 |
| EP | 1365433 | A1 | 11/2003 |
| JP | 07-302537 | * | 11/1995 |
| JP | 08315712 | A | 11/1996 |
| WO | WO 02/061786 | A1 | 8/2002 |

* cited by examiner

*Primary Examiner*—Saul Rodriguez
*Assistant Examiner*—Paul T Chin
(74) *Attorney, Agent, or Firm*—Sughrue Mion, PLLC

(57) ABSTRACT

A device for removing or inserting a fuse, in particular an automotive safety fuse from or into a fuse base in a fuse strip. The device has a first and a second elongate arm each of which has a distal end and a proximal end whereby an engaging section that may be brought into engagement with the fuse is provided in the distal end portion of the first and the second arm. The device further includes a first connecting section connecting the first and the second arm to each other and provided proximally to the engaging section. The device has a second connecting section to connect the arms at a distance proximally to the first connecting sections and the first and second arms are articulated in such a way that reducing the distance between the two arms in the portion between the two connecting sections causes the distance between the distal ends of the two arms to increase, and that reducing the distance of the two arms in the portion proximal to the second connecting section causes the distance between the distal ends of the two arms to decrease.

16 Claims, 2 Drawing Sheets

DEVICE FOR REMOVING OR INSERTING A FUSE WITH AN IMPROVED HOLDING AND RELEASE MECHANISM

FIELD OF THE INVENTION

The invention relates to a device for removing or inserting a fuse, in particular an automotive safety fuse, from or into a fuse-base in a fuse strip. The features in the preamble of claim 1 are known from DE 695 10 639 T2.

PRIOR ART

An extremely wide variety of devices for removing or inserting fuses of different DIN shapes from or into a fuse-base in a fuse strip is known from the prior art.

For example, known from DE 695 10 639 T2 is a one-piece, plastic, injection-moulded removing device or puller with two elongate, plate-shaped arms connected by an elastic connecting section. The connecting section has a curved shape so that reducing the distance between the ends of the two arms at one end of the device causes the opposite arm ends to spread, thus bringing the claws provided on the internal surface of the arms into engagement with a fuse to be removed or inserted. The connecting section, therefore, represents an articulated connection connecting the two arms to each other in an articulated way.

Also known from WO 02/061786 A1 is a fuse puller with different designs of engaging sections on the end areas of the elongate device in order to increase its versatility. Since the engaging sections at both ends of the device have different designs, the device may be used to remove or insert fuses and relays of different dimensions and DIN shapes from or into a fuse-base in a fuse strip.

When using the removing devices known from the prior art, a problem may arise in that, after the ends of the device have spread and the engaging sections provided at these ends have been brought into engagement with the fuse to be removed or inserted, for example with a gripping profile on the fuse, it is furthermore necessary to apply a force to the opposite end of the device in the longitudinal direction of the device in order to safely remove or insert the fuse from or into the fuse base. A force of this type, after the device has been attached to the fuse, may cause the ends which are engaged with the fuse to spread again with the result that the engaging sections or gripping hooks provided on the device do not remain correctly in the gripping profile of the fuse. Therefore, there is a probability of the device's gripping hooks to become detached from the fuse's gripping contour, and hence safe removal of the fuse is no longer guaranteed. The fuse jumps out of the removal device's engaging sections and, in the worst case, remains in the fuse-base in the fuse strip.

In response to the continuously increasing density of the fuses in a fuse-base in a fuse strip and the progressive miniaturisation of electronic components, for example relays, and consequently the denser arrangement of these components on the mounting plates or plug-in boards provided for this purpose in conjunction with the provision of these fuse-bases and mounting boards in locations that are very difficult to access, for example below or behind the instrument panel or in the engine compartment of a car, there is a requirement for a removing tool enabling the safe and problem-free removal of these electronic components, such as, for example, fuses or relays.

Due to the voltage applied to these components, they have to be protected from water or moisture, so that, under certain circumstances, these components are surrounded by side walls and a cover plate, and consequently only very small gaps remain between the components and the side walls protecting these components which makes access very difficult for an operator tasked with the replacement of these components. Therefore, it is very difficult to remove and insert the components from or into the fuse-base with a conventional removing device in a safe and problem-free way.

SUMMARY OF THE INVENTION

It is an object of the present invention to provide a removing device for electronic components that may be used in particular for fuses, and enables electronic components in very dense arrangements in difficult-to-access places, from a long distance, to be removed from or inserted in a plug-in board or a fuse-base in a fuse strip in a safe and problem-free way.

This object is achieved by the features of independent claim 1.

Preferred embodiments of the present invention are subject of dependent claims 2 to 16.

One preferred embodiment of the removing device comprises a first and a second elongate arm each with a distal and a proximal end, whereby the distal end portion of the first and/or second arm has an engaging section that may be engaged with the fuse, and which also has a first connecting section connecting the first and second arms to each other provided proximally of the engaging section. The device according to the invention is characterised in that a second connecting section connecting the arms is provided proximally to the first connecting section, and that the first and second connecting sections and the first and second arms have articulated connections which are arranged in such a way that reducing the distance between the two arms in the area between the two connecting sections causes the distance between the distal ends of the two arms to increase, and reducing the distance between the two arms in the area lying proximally to the second connecting section causes the distance between the distal ends of the two arms to decrease.

A device of this type ensures that, when the portion of both arms lying between the two connecting sections is compressed, the distance between the distal ends, that is to say the ends of the device facing away from the operator, of both arms is enlarged, thus enabling the device to be attached to an electronic component, and then the operator reduces the force on this portion causing the engaging section at the distal end of the device to be locked with the gripping profile provided on the electronic component. When the device is locked with the electronic component in this way, the operator can then, once again, apply a force to the proximal end portion of the two arms of the device so that the engaging section at the distal end of the two arms remains in a fixed and safe engagement with the electronic component. It goes without saying that this locking is further supported or intensified by this force and the operator can then pull the electronic component out of the plug-in board provided for this purpose. The force required to pull the electronic component out of the plug-in board also helps, so to speak, to intensify the locking of the device with the electronic component, thus preventing the electronic component from sliding out of the device's engaging section.

Another preferred embodiment has at least four articulated connections, whereby two of the at least four articulated connections are provided on the first and second arms in the portion between the two connecting sections. Advantageously, the articulated connections provided in the portion between the two connecting sections are formed by reducing the wall thickness of the two arms.

This advantageous arrangement and configuration of the articulated connections ensures that the two arms have an opposing V-shaped movement relative to each other, with the tip of the "V" in each case representing the articulated connection provided on the two arms in the portion between the two connecting sections. This opposing V-shaped arm movement makes a substantial contribution to the function of the device according to the invention.

Another preferred embodiment of the device envisages two curved connecting sections that are arranged in opposite orientation to each other resulting in a minimum distance between the two connecting sections. Advantageously, the connecting sections are made from an elastic material.

A configuration of the two connecting sections of this type ensures good leverage. The provision of two additional articulated connections on each of the arms in the portion between the connecting sections ensures good transmission of a force applied to an end portion of the two arms to the opposite end portion of the two arms. Optimised load distribution in the material of the two connecting sections is also guaranteed.

Another preferred embodiment envisages that the connecting sections are plate-shaped, and that advantageously four articulated connections are provided on the end sections of the two plate-shaped connecting sections on which the two connecting sections are each connected to the two arms. Therefore, an embodiment of this type envisages a total of six articulated connections with three articulated connections on each arm which also achieves good leverage and good force transmission, as described above. Advantageously, the articulated connections provided on the end sections of the two plate-shaped connecting sections are formed by reducing the wall thickness of the latter.

Another preferred embodiment envisages an engaging section on the internal surface of each of the two arms in their end portion, whereby the engaging section preferably has a claw arrangement and a counter bearing which may be brought into engagement with the electronic component or the fuse.

The claw arrangement ensures engagement with the gripping profile provided on the fuse, whilst the counter bearing provides the operator with a tactile feedback confirming that the engaging section provided on the end portion of the two arms is fully engaged with the fuse or with the electronic component.

Another preferred embodiment envisages engaging sections on both end portions of the arms, preferably with different designs. This enables one and the same device to be used to remove or insert fuses of different sizes and belonging to different DIN-types, which also results in cost saving since there is no need to use different removing devices for different fuses or electronic components.

Preferably, the engaging sections are attached removably to the internal surfaces of the respective arms, thus enabling them to be replaced by different designs of engaging sections in a simple way, which in turn additionally increases the versatility of the device.

Advantageously, provided on the internal surface at both end sections of the respective arms, are reinforcing ribs extending in the longitudinal direction of the arms, thus resulting in improved force transmission and increasing the rigidity of the device.

Preferably, ribs extending transversely to the longitudinal direction of the arms are provided on the external surface in the end portion of both arms, thus making the device easier for an operator to manipulate since the risk of the operator's fingers slipping is reduced.

BRIEF DESCRIPTION OF THE DRAWINGS

In the following, the invention is described by way of example with reference to the attached drawings, in which.

MODES OF THE INVENTION

In the following, the end of the removing device facing away from the operator will be referred to as the "distal end", while the end of the removing device facing towards the operator will be referred to as the "proximal end".

The removing device according to the invention is used not only for the removal or insertion of fuses, in particular safety fuses from or into a fuse-base in a fuse strip, but can also be used to remove or insert electronic components integrated in an electric circuit by means of a plug-in board from or into the plug-in board.

The engaging sections provided on the end portions of the removing device should be designed to match the engaging profile or gripping profile of the electronic components, thus ensuring the problem-free removal or insertion of the electronic components from or into the plug-in board.

However, it should be noted at this point that the removing device according to the invention is preferably intended to be used for the removal or insertion of fuses according to DIN 72581-3 with shapes C, E and F (manufacturers: Audio Ohm, MTA, Littelfuse and Pudenz).

In both Figures, the same reference numbers identify identical or similar elements or sections of the removing device.

Figure 1:
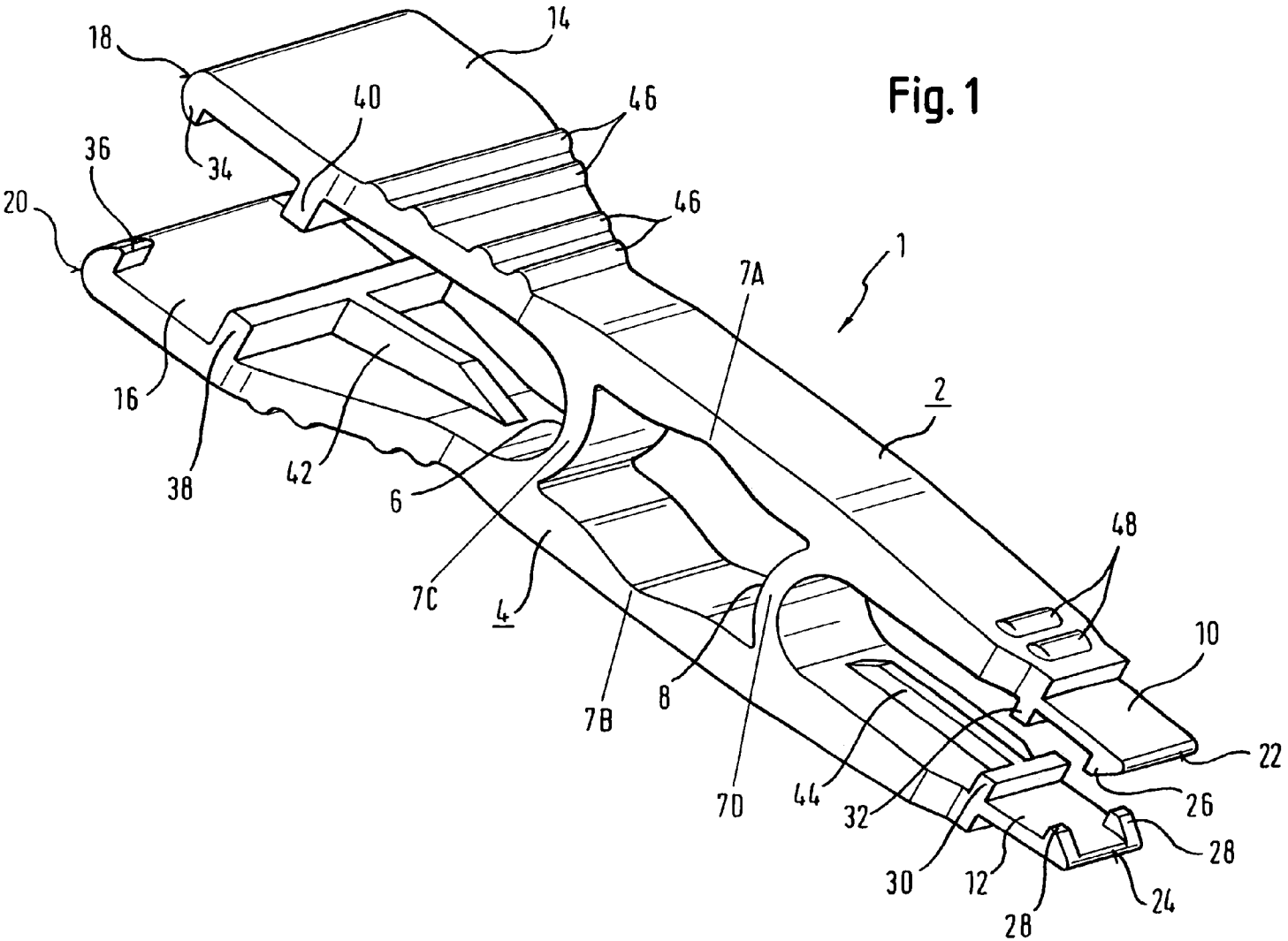
FIG. 1 is a perspective view of a first embodiment of the removing device according to the invention.

FIG. 1 is a perspective view of a first embodiment of the removing device according to the invention. The removing device is generally indicated by reference number 1.

The device has two elongate arms 2, 4 which are substantially arranged parallel to each other. However, also conceivable are arrangements in which the arms are not arranged parallel to each other.

Arms 2, 4 are connected to each other in a central portion by two connecting sections 6, 8. The connecting sections 6, 8 of the first embodiment of the device according to the invention have a curved shape, whereby the distance of the connecting sections in the longitudinal direction of the arms is shortest in a central portion of the connecting sections. In other words, the first connecting section 8 is curved towards the left end of the device in FIG. 1, while the second connecting section 6 is curved towards the right end of the device in FIG. 1.

Outside the area of the arms 2, 4 defined by the connecting sections 6, 8, the device 1 has an engaging section 10, 12 or 14, 16 at the respective end section. On the internal surface of the arm 2, the engaging section 10 has two claws 26 being flush with the end 22 (the second claw is not shown in FIG.

1), while the engaging section 12 has two claws 28 on the internal surface of the arm 4 being flush with the end 24. Counter bearings 30, 32 are provided on both engaging sections 10, 12 on the internal surface of the respective arms 2, 4. The claws 26, 28 and the counter bearings 30, 32 engage the gripping contour of a fuse to be removed or inserted.

Provided on the opposite end section in the longitudinal direction of the arms 2, 4, the proximal end section of the device, are two further engaging sections 14, 16 which both have, on the internal surface of the arms 2, 4 in each case, claws 34 that are flush with the end 18 and claws 36 that are flush with the end 20. Also provided are counter bearings 38, 40 also on the internal surface of the arms 2, 4 at a distance from the claws 34, 36. The claws 34, 36 or the counter bearings 3.8, 40 form corresponding engaging sections 14, 16 that engage with the gripping profile of a fuse to be removed or inserted.

As shown in FIG. 1, the distance between the claws 26 and the counter bearings 32 or the claws 28 and the counter bearings 30 is different from the distance between the claws 34 and the counter bearings 40 or between the claws 36 and the counter bearings 38. This means that the same removing device may be used to remove or install fuses of different sizes and different DIN-shapes.

Also taken into consideration is the possibility of designing the engaging sections 10, 12, 14 and 16 to match different fuse or electronic component gripping profile designs. Similarly, the engaging sections 10, 12, 14 and 16 may be attached removably to the respective arms, thus additionally increasing the versatility of the removing device.

On the internal surface of the arm 4, reinforcing ribs 42, 44 are provided between the connecting sections 6, 8 and the counter bearings 30, 38 to endow the arm 4 with additional rigidity. The reinforcing ribs are substantially provided along a centre line of the arm 4, but could, however, be arranged and designed in a different way as long as they endow the arm with a certain rigidity. Similar rib designs are provided on the internal surface of the arm 2. However, these are not shown in FIG. 1.

Provided on the external surface of the arms 2, 4 in the portion outside the connecting sections 6, 8 are ribs 46, 48 that assist the manipulability of the device and should prevent the operator's fingers from slipping.

The entire device is preferably formed as a single piece from an elastic material by means of an injection moulding process. A person skilled in the art is sufficiently familiar with suitable plastics, and they will, therefore, not be described in any more detail here.

The device shown in FIG. 1 has four articulated connections to facilitate the mode of operation of the device described in the following.

The first two articulated connections 7A, 7B are provided on the arms 2, 4 in the portion between the connecting sections 6, 8. These two articulated connections are formed by reducing the wall thickness of the arms 2, 4. In addition, two articulated connections are provided on the two connecting sections 6, 8, and to be precise, in the portion of the two connecting sections 6, 8 which have the shortest distance between each other in the longitudinal direction of the arms 2, 4.

The following describes the mode of operation of the removing device 1, as shown in FIG. 1, to remove a fuse from a fuse-base in a fuse strip.

The operator preferably places his thumb on the external surface of the arm 2 and his index finger on the external surface of the arm 4, to be precise in the portion of the two arms located between the two connecting sections. This portion of the removing device is then slightly compressed, causing the distance between the two arm ends 22, 24 or 18, 20 to increase, thus bringing the fuse to be removed into engagement with, for example, the engaging sections 10, 12 in the distal end portion. The widening or spreading of the two arm ends 22, 24 is hereby facilitated by the arrangement of the articulated joints 7A, 7B, 7C and 7D according to the invention.

The reduced wall thickness of the two arms 2, 4 at the articulated points 7A, 7B causes them to be pressed inwardly, and the curved connecting sections to be more strongly bent at the articulated points 7C, 7D, resulting in the widening of the arm ends 22, 24 or 18, 20. If the force applied by the operator on the above-described central portion of the device is reduced, and if the fuse to be removed is located between the engaging sections 10, 12, the arm portion moves at the articulated points or articulated connections 7A, 7B outwardly, and the curvature of the connecting sections 6, 8 is simultaneously reduced, causing the arm ends 22, 24 or 18, 20 to move towards each other again. In this way, the engaging sections 10, 12 are brought into engagement with the gripping profile on the fuse.

When the fuse has locked with the engaging section 10, 12, the operator removes his hand from the central portion of the removing device, that is the portion of the arms 2, 4 lying between the connecting sections 6, 8, and moves his thumb and index finger in the proximal direction towards the portion of the removing device which has ribs 46 on the external surface of the arms 2, 4. If the operator again applies force to this portion having the ribs 46, the engagement or the locking of the engaging sections 10, 12 with the fuse's gripping profile is so-to-speak additionally reinforced. This force applied to the portion having the ribs 46 is also required to remove the fuse, and therefore, this force fulfils a sort of dual function, namely both the removal of the fuse from the fuse-base in the fuse strip and the support of the locking of the engaging sections 10, 12 with the fuse's gripping profile. This enables the safe and problem-free removal of the fuse and prevents the engaging sections 10, 12 from slipping off the fuse in the distal end portion of the removing device.

Here, the articulated connections 7A, 7B are used to transmit force, that is a pressure force applied to the proximal end portion of the removing device is transmitted to the distal end portion of the removing device. The articulated connections 7C, 7D on the connecting sections 6, 8 hereby achieve the necessary leverage which may be varied as required due to the fact that the operator is able to choose the point on the external surface of the two arms 2, 4 to which a pressure force is applied proximally to the connecting section 6. The further away this point is from the connecting section 6, the greater the leverage and the force applied to the fuse to be removed.

The above-described mode of operation equally applies, when the engaging sections 14, 16 are brought into engagement with a fuse to be removed.

Figure 2:
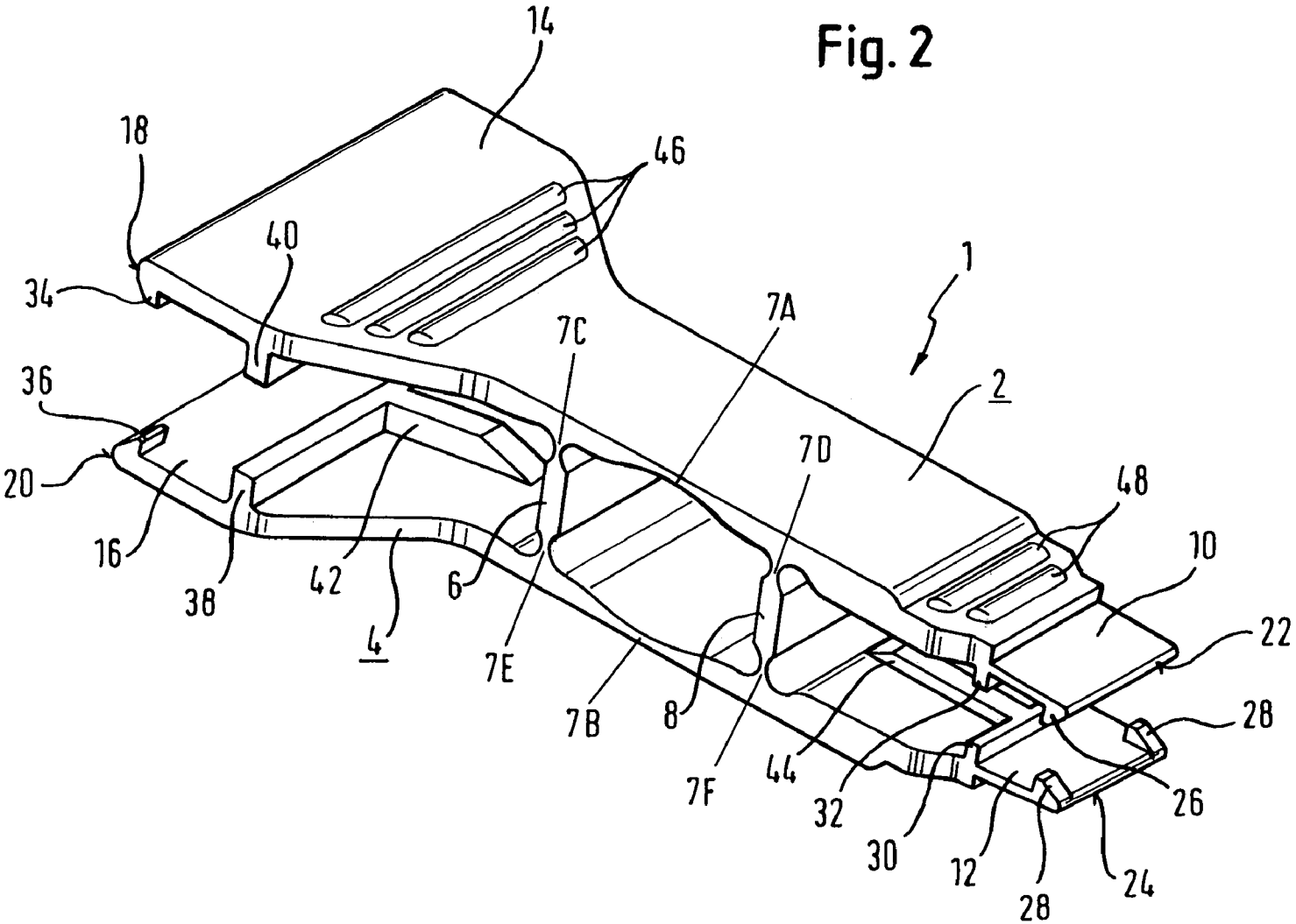
FIG. 2 is a perspective view of a second embodiment of the removing device according to the invention.

FIG. 2 shows a second embodiment of the removing device according to the invention. However, here only those parts of this embodiment that differ from the embodiment shown in FIG. 1 will be described.

The second embodiment differs substantially from the first embodiment in the different arrangement of the articulated connections.

FIG. 2 shows six articulated connections 7A, 7B, 7C, 7D, 7E and 7F. The two articulated connections 7A, 7B hereby correspond to the articulated connections 7A, 7B identified with the same reference numbers in the first embodiment.

Due to the plate-shaped design of the connecting sections 6, 8, articulated connections 7C, 7E or 7D, 7F are arranged on their edges facing the internal surfaces of the arms 2, 4 which help to achieve the leverage. The application of a pressure force on the proximal end portion of the removing device, preferably on the portion having the ribs 46, causes the proximal half of the portion of the arms 2, 4 defined by the connecting sections 6, 8 to spread, causing the portion of the arms 2, 4 between the connecting sections 6, 8 to take on an opposing V-shape, and thus the ends 22, 24 at the proximal end of the removing device are approximated. The same applies if a pressure force is applied to the portion of the removing device having the ribs 48.

The removing device or puller of the first and second embodiment is preferably produced as a single piece of an elastic material by means of an injection moulding process.

It should be noted at this point that fuses or electronic components of different widths may be removed from a fuse-base in a fuse strip or plug-in board by means of the removing device since the distance between the claws or gripping hooks 26, 28 or 34, 36 may be varied in a simple way. In addition, the removing device according to the invention may be used to remove fuses with different transverse dimensions since both end sections of the removing device have engaging sections 10, 12 or 14, 16 with different widths.

Also taken into consideration is the possibility of bringing suitably designed inserts into engagement with the internal surfaces of the arms in their proximal and/or distal end portions, whereby these inserts have specially designed claw arrangements to enable fuses with different gripping profiles to be removed or installed with the same removing device.

Also conceivable is the provision of a light source in the removing device to facilitate the detection of fuses in poorly lit areas below an instrument panel or other difficult-to-access areas inside the engine compartment. For example, a light-emitting diode may be arranged on the reinforcing ribs 42, 44 for this purpose which is activated, when the portion of the two arms 2, 4 lying between the connecting sections 6, 8 is compressed.

The essential aspect of the invention is the fact that an advantageous arrangement of articulated connections ensures that a pressure force applied to one end portion of the removing device generates a pressure force at the opposite end portion of the removing device. This ensures that the force required to remove the fuse from the fuse-base is also used to increase the pressure force on the engaging section engaged with the fuse. This is achieved by a serially arranged double-tilting movement of the respective arms, whereby two articulated connections account for the transmission of the force, and the other articulated connections account for the leverage.

As already mentioned at the beginning, the removing device may be used not only for the removal or insertion of fuses from or into a fuse-base in a fuse strip, it is also conceivable to use the removing device for removing or inserting different designs of electronic components from or into a plug-in board.

The invention claimed is:

1. A device for the removal or insertion of a fuse, in particular an automobile safety fuse, from or into a fuse-base in a fuse strip, comprising:

a first and a second elongate arms each having a distal end and a proximal end, the distal end portion of at least one of the first and the second arms having an engaging section that is engageable with the fuse;

a first connecting section connecting the first and the second arms with each other and being provided proximally to the engaging section;

a second connecting section being provided at a distance proximally to the first connecting section to connect the first and the second arms, wherein the first and the second connecting sections and the first and the second arms have articulations arranged in such a way that reducing the distance between the two arms in the portion between the two connecting sections causes the distance between the distal ends of the two arms to increase, and that reducing the distance between the two arms in the portion lying proximally to the second connecting section causes the distance between the distal ends of the two arms to decrease, and wherein the articulations on the two arms in the portion between the two connecting sections are formed by reducing the wall thickness of the two arms.

2. The device according to claim 1, wherein at least four articulations are provided, two of the at least four articulations are provided on the first and second arm in the portion between the two connecting sections.

3. The device according to claim 1, wherein an articulation is provided in each of the two connecting sections in a central portion thereof.

4. The device according to claim 3, wherein the two connecting sections are curved, and the distance between the connecting sections in the longitudinal direction of the arms is shortest in the portion of the two articulations.

5. The device according to claim 3, wherein the connecting sections are made of an elastic material.

6. The device according to claim 1, wherein the two connecting sections are plate-shaped.

7. The device according to claim 6, wherein four articulations are provided on the end portions of the two plate-shaped connecting sections, at which the two connecting sections are each connected to the two arms.

8. The device according to claim 6, wherein the four articulations are formed by reducing the wall thickness of the two plate-shaped connecting sections.

9. The device according to claim 1, wherein the entire device is made of plastic and is elastic.

10. The device according to claim 1, wherein the distal end portion of both arms have an engaging section provided on an internal surface of both arms, the engaging section having a claw arrangement and a counter bearing which is engageable with the fuse.

11. The device according to claim 1, further comprising a second engaging section with a claw arrangement and a counter bearing on the internal surface of the proximal end portion of the two arms.

12. The device according to claim 1, wherein an internal surface in the distal end portion of both arms has an engaging section, the engaging section having a claw arrangement and a counter bearing being engageable with the fuses; and the device further comprising another engaging section with a claw arrangement at the proximal end portion of the two arms; and wherein the two engaging sections in the distal and the proximal end portions have different widths.

13. The device according to claim 1, wherein both arms have reinforcing ribs on the internal surface of the distal and proximal end portion, both of which extend in the longitudinal direction of the arms.

14. The device according to claim 1, further comprising reinforcing ribs on the external surface of both arms in the distal and proximal end portion extending transversely to the longitudinal direction of the arms.

15. The device according to claim 1, wherein the two arms are substantially arranged parallel to each other.

16. The device according to claim 1, wherein only the first and the second connecting section are provided to connect the first and the second arm with each other.

* * * * *